US006217366B1

(12) United States Patent
Weisstock

(10) Patent No.: US 6,217,366 B1
(45) Date of Patent: Apr. 17, 2001

(54) RELEASABLE CORD COUPLER

(76) Inventor: Walter Weisstock, 618 San Michelle Road, Kelowna, British Columbia (CA), V1W 2J1

( * ) Notice: Subject to any disclaimer, the term of this patent is extended or adjusted under 35 U.S.C. 154(b) by 0 days.

(21) Appl. No.: 09/440,684

(22) Filed: Nov. 16, 1999

Related U.S. Application Data

(60) Provisional application No. 60/108,503, filed on Nov. 16, 1998.

(51) Int. Cl.[7] ..... H01R 13/62
(52) U.S. Cl. ..... 439/369; 439/367
(58) Field of Search ..... 439/369, 367, 439/368, 370, 371, 373

(56) References Cited

U.S. PATENT DOCUMENTS

| | | | |
|---|---|---|---|
| 4,097,105 | 6/1978 | Zumwalt | 339/75 P |
| 4,440,456 | 4/1984 | Klusman | 308/184 R |
| 4,514,026 | 4/1985 | Herbert | 339/75 P |
| 4,596,430 | 6/1986 | Olson | 339/75 P |
| 4,690,476 | 9/1987 | Morgenrath | 439/502 |
| 4,702,540 | 10/1987 | Siemon | 439/371 |
| 4,854,015 | 8/1989 | Shaull | 24/16 R |
| 4,907,984 | 3/1990 | Keller | 439/369 |
| 4,917,626 | 4/1990 | Barton | 439/369 |
| 4,957,450 | 9/1990 | Pioszak | 439/369 |
| 5,015,251 | 5/1991 | Cherubini | 606/203 |
| 5,075,933 | 12/1991 | Kemper | 24/16 R |
| 5,075,934 | 12/1991 | Osedo | 24/16 R |
| 5,104,335 | 4/1992 | Conley et al. | 439/369 |
| 5,133,671 | 7/1992 | Boghosian | 439/371 |
| 5,167,524 | 12/1992 | Falcon et al. | 439/371 |
| 5,168,603 | 12/1992 | Reed | 24/16 R |
| 5,336,107 | 8/1994 | Sheryll | 439/369 |
| 5,732,445 | 3/1998 | Stodolka et al. | 24/16 R |
| 5,733,138 | 3/1998 | Kramer | 439/369 |
| 5,745,958 | 5/1998 | Kaldor | 24/16 R |

*Primary Examiner*—Gary F. Paumen
*Assistant Examiner*—Alexander Gilman
(74) *Attorney, Agent, or Firm*—Antony C. Edwards

(57) ABSTRACT

The cord coupler of the present invention includes a flexible planar first sheet of hook and loop fastener material. A first side of the first sheet includes hook material of the hook and loop fastener material. An opposite second side of the first sheet includes loop material of the hook and loop fastener material. The first sheet is formed into at least three portions. A first portion is elongate in a first direction from a first end to an opposite second end. A second portion is elongate in a second direction from a first end to an opposite second end. A third portion is elongate in a third direction from a first end to an opposite second end. The first direction is perpendicular to the second and third directions. The second and third directions are parallel. The second portion is adjacent the third portion. The first ends of the second and third portions are formed integrally with the first end of the first portion.

15 Claims, 6 Drawing Sheets

RELEASABLE CORD COUPLER

CROSS REFERENCE TO RELATED APPLICATION

This application claims priority from U.S. Provisional Patent Application No. 60/108,503 filed Nov. 16, 1998 titled Releasable Cord Coupler.

FIELD OF THE INVENTION

This invention relates to the field of devices for securing electrical connectors, such as the male and female ends associated with power conducting cords used for extension cords and power tool electrical cords and the like, in assembled, united or mated engagement so that the plugs are prevented from being accidentally separated.

BACKGROUND OF THE INVENTION

It is an identified problem in the prior art that male and female plugs on the ends of power conductors such as electrical extension cords and power tool electrical cords and the like may be accidentally separated if the junction between the cords is pulled under tension without some sort of restraining device coupling the male and female plugs together in mated engagement.

It is known that most power tools and heavy duty appliances include a relatively short power cord or rigid receptacle having a pronged male electrical connector at the end thereof. Typically the ends of the power cords are the only means provided by which extension cords may be connected to the power cords to provide power to the tools. Realistically, power tools are routinely used with extension cords and a user while moving about, for example at a work site, will quite often reach an outer limit of the range afforded by the extension cord and will inadvertently pull on the power tool thereby separating the junction between the power tool cord and the extension cord. More aggravatingly, a junction between connected extension cords removed from the location of the user requires the user to walk across the job site to locate separated connectors between extension cords.

Quite apart from the aggravation and inefficiency of such a situation, the partial separation of electrical connectors is also potentially hazardous. Consequently, the need identified in the prior art and attempted to be solved in the prior art exists to releasably secure by means of a releasably mountable device, male and female electrical plugs in mated engagement.

In the prior art devices, U.S. Pat. No. 5,167,524 which issued to Falcon on Dec. 1, 1992, identifies many prior art attempts to solve the above problem as such devices existed in the published prior art up to 1991. The Falcon device itself is a coupling restraint assembly which includes a pair of generally identically configured U-shaped flexible mounting straps which are secured relative to each of the male and female connectors in opposing relationship with respect to one another using integrally formed locking tabs which are extendible through openings provided in each strap. The mounting straps are constructed so as to be used interchangeably on different types and sizes of power cords and electrical connectors. In the embodiment taught to be preferred by Falcon, a pair of selfbinding restraint straps are secured to two legs of one of the generally U-shaped mounting straps and are selectively extendible through openings in opposing leg portions of the adjacent mounting strap. The restraint straps are secured upon themselves by use of hook and loop releasable fasteners.

What is neither taught nor suggested, and which is an object of the present invention to provide, is a coupling device superficially similar in plan view profile to the Falcon device when laid flat, but one which is of simplified construction when compared thereto for ease of manufacture and of increased tensile load bearing capacity. Load bearing capacity is increased due to the lack of apertures formed as tensile load transfer couplings between a base portion to which are mounted a pair of generally parallel straps. The present invention has no such limitation, being formed of a unitary piece which may be cut out of a sheet in a "cookie-cutter" fashion as better described below.

Applicant is also aware of U.S. Pat. No. 5,336,107 which issued to Sheryll on Aug. 9, 1994 for a plug retention device. Sheryll discloses a device for retaining an electrical plug and extension cord to another plug and extension cord by the use of fasteners strip elements secured to each cord adjacent to each plug by a circumferential clamp. With the electrical plug engaged with its corresponding socket, mechanical interacting fastener elements that engage each other when in the assembled state maintain the plug in the socket. It is taught that the fastening elements may be mushroom-shaped fasteners sold under the trademark Dual Lock or other forms of interacting article elements of the type the subject of the U.S. Pat. Nos. 3,192,589 and 3,266,113. What is neither taught nor suggested is a coupler adapted for use in storing a coiled extension cord, the Sheryll device also being of a molded plastic design not well adapted for being formed in a unitary piece cut out from a sheet in a "cookie-cutter" fashion.

SUMMARY OF THE INVENTION

In summary, the cord coupler of the present invention includes a flexible planar first sheet of hook and loop fastener material. A first side of the first sheet includes hook material of the hook and loop fastener material. An opposite second side of the first sheet includes loop material of the hook and loop fastener material. The first sheet is formed into at least three portions. A first portion is elongate in a first direction from a first end to an opposite second end. A second portion is elongate in a second direction from a first end to an opposite second end. A third portion is elongate in a third direction from a first end to an opposite second end.

The first direction is perpendicular to the second and third directions. The second and third directions are parallel. The second portion is adjacent the third portion. The first ends of the second and third portions are formed integrally with the first end of the first portion.

A first plug on one end of a first electrical cord may be laid between the second and third portions so as to dispose a coupling end of the first plug away from the first portion and so as to lay the first electrical cord perpendicularly across the first portion. The first portion may be wrapped around the first electrical cord so as to releasably fasten the first end of the first portion to the second end of the first portion thereby forming a collar secured on the first electrical cord behind the first plug. The wrapping of the first portion around the first electrical cord oppositely rotates the second and third portions relative to each other into generally opposed facing relation on opposite sides of the first plug. The second and third portions are thus positioned either for releasable fastening to corresponding releasable fasteners on a second plug when mated to the first plug, or for securing the first electrical cord, when coiled, to the first plug by wrapping and releasably securing the second and third portions around coils of the first electrical cord when coiled.

The corresponding releasable fasteners on the second plug may be second and third portions of a second sheet substantially identical to the first sheet. The second sheet is mounted to the end of the second electrical cord behind the second plug by wrapping a first portion of the second sheet around the second electrical cord behind the second plug. The second portions and the third portions of the first and second sheets may be overlapped into releasably fastened engagement so as to releasably secure the first plug coupled to the second plug.

Alternatively, the corresponding releasable fasteners on the second plug may be strips of releasable fastener material mounted directly onto opposite sides of the second plug. In this case, the second plug may be an electrical plug rigidly mounted to an appliance such as a hand tool. Advantageously, the first sheet is, or the first and second sheets are, double-sided hook and loop material or equivalent having solely hook pile or equivalent on the first side, and having solely loop pile or equivalent on the second side. The sheet or sheets may be cut to shape by a cookie-cutter method from a bulk supply of the double-sided hook and loop material.

In one aspect of the present invention, at least one stress reduction cut-out is formed in the first sheet between the first ends of the first, second and third portions. This may include a first stress reduction aperture between the first ends of the second and third portions so as to form one end of an elongate split running along the length of, and between, the second and third portions. The second and third portions may be, but are not necessarily immediately adjacent to each other.

The stress reduction cutouts may further include oppositely disposed, substantially semi-circular notches formed in opposite sides of the first ends of the second and third portions immediately adjacent the first end of the first portion. The first stress reduction aperture may be substantially circular.

In terms of dimensions, defining the first, second and third portions as having corresponding first, second and third lengths, the first length is generally equal to the second and third lengths. Defining the first, second and third portions as having corresponding first, second and third widths, measured lying in a plane of the sheet, the first width may be less than the second and third widths and the second and third widths may be substantially equal.

DETAILED DESCRIPTION OF PREFERRED EMBODIMENTS

Figure 1:
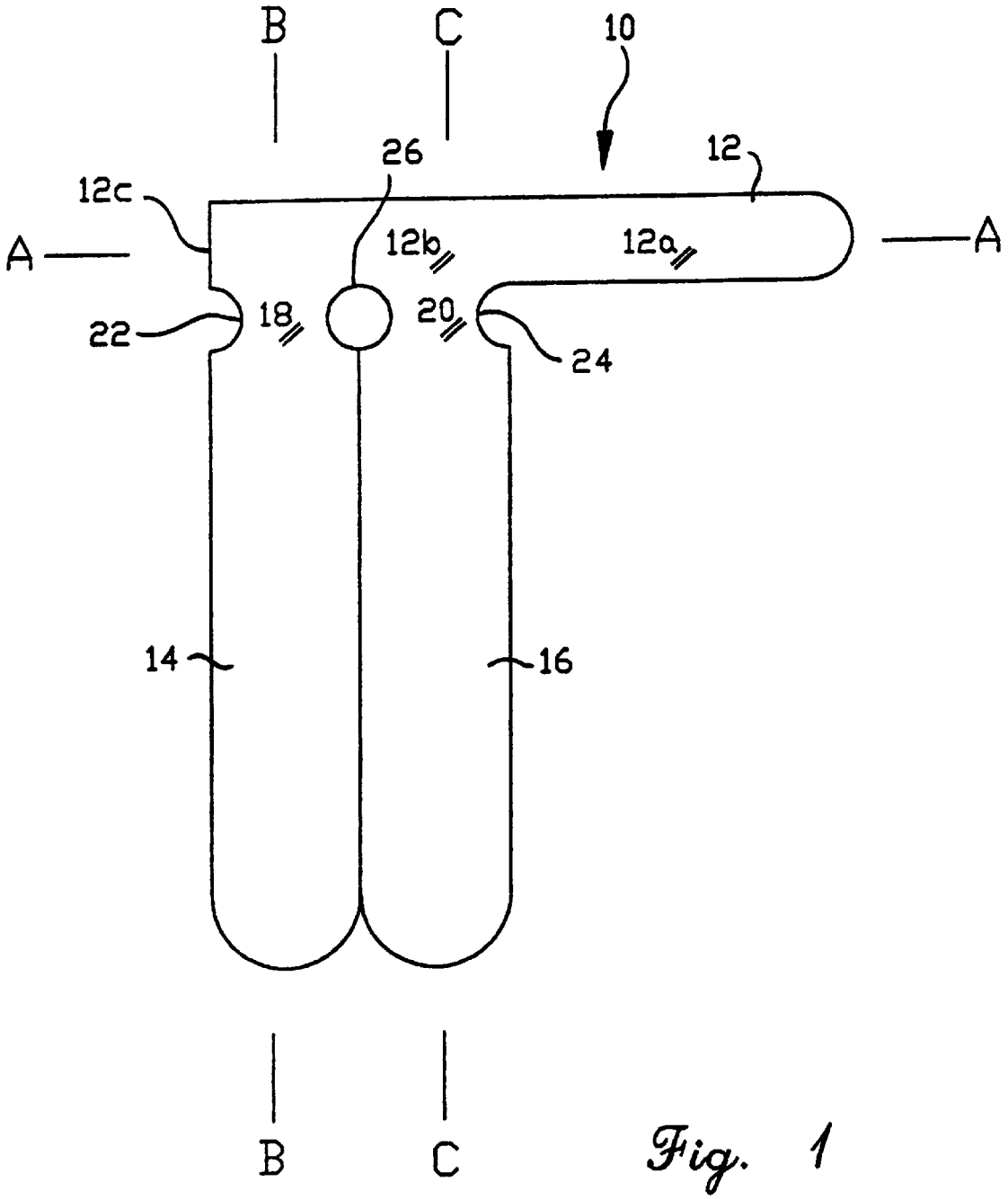
FIG. 1 is, in plan view, the coupler of the present invention.
Figure 2:
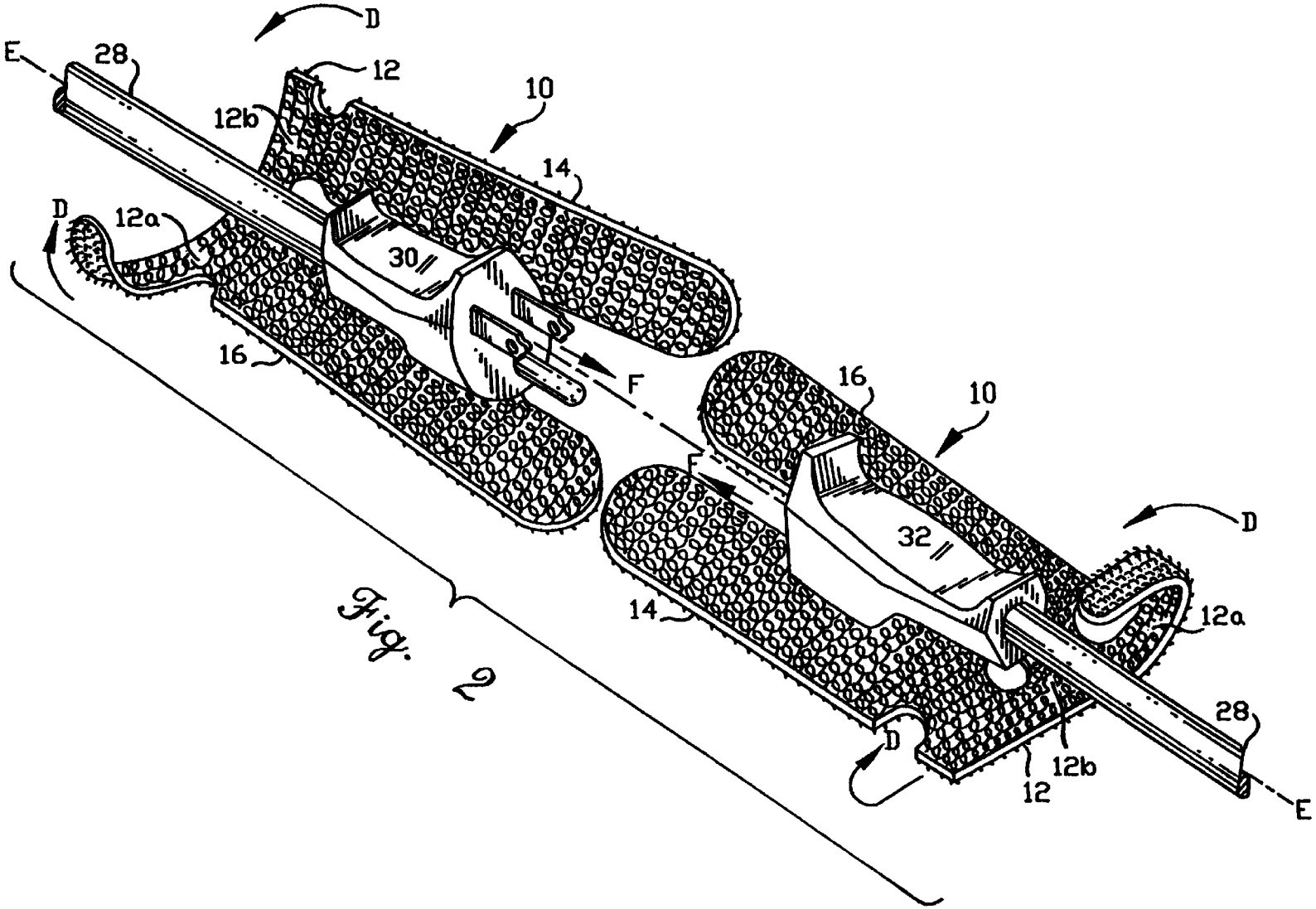
FIG. 2 is, in exploded perspective view, a pair of couplers of the present invention being mounted onto the ends of electrical cords.

As best seen in its open position in FIGS. 1 and 2, coupler 10 has a collar-forming first portion 12. When coupler 10 is laid flat, first portion 12 extends generally along axis A. It is integrally formed at one end thereof with a pair of elongate generally parallel portions, namely, second portion 14 and third portion 16. Second portion 14 and third portion 16 extend along their respective longitudinal axes B and C, where advantageously, axis A is generally perpendicular to axes B and C.

Goosenecks 18 and 20 may, in one preferred embodiment, be formed at intersections between second portion 14 and third portion 16 respectively with first portion 12. Goosenecks 18 and 20 may be formed by hemispherical cut-outs 22 and 24 on opposite sides of, respectively, second portion 14 and third portion 16 and by circular cut-out 26 formed between second portion 14 and third portion 16.

Goosenecks 18 and 20 allow for rotation .of second portion 14 and third portion 16 about their respective longitudinal axes B and C so as to advantageously allow for alternative use of these portions as described below.

FIG. 1 illustrates the coupler of the present invention laid flat. As may be better appreciated by reviewing FIGS. 2 and 3 the coupler 10 when laid flat is a thin generally planar sheet which may be thought of as L-shaped. In the preferred embodiment, coupler 10 is cut for example by means of a cookie-cutter manufacturing process, from sheets of double sided hook and loop fastening material such as manufactured and sold under the trademark Velcro™ or from sheets of substrate material having Dual-Lock mushroom-type fasteners or other stud-shaped fasteners or the like. In the Velcro™ embodiment, the hook and loop double sided sheet material has the loop surface on one side of the sheet and the hook surface on the opposite side of the sheet. Hereinafter, references to hook and loop fasteners and double-sided hook and loop material is intended to include, without limiting, other similarly functioning releasable fastening material available in double-sided flexible sheet form.

Figure 3:
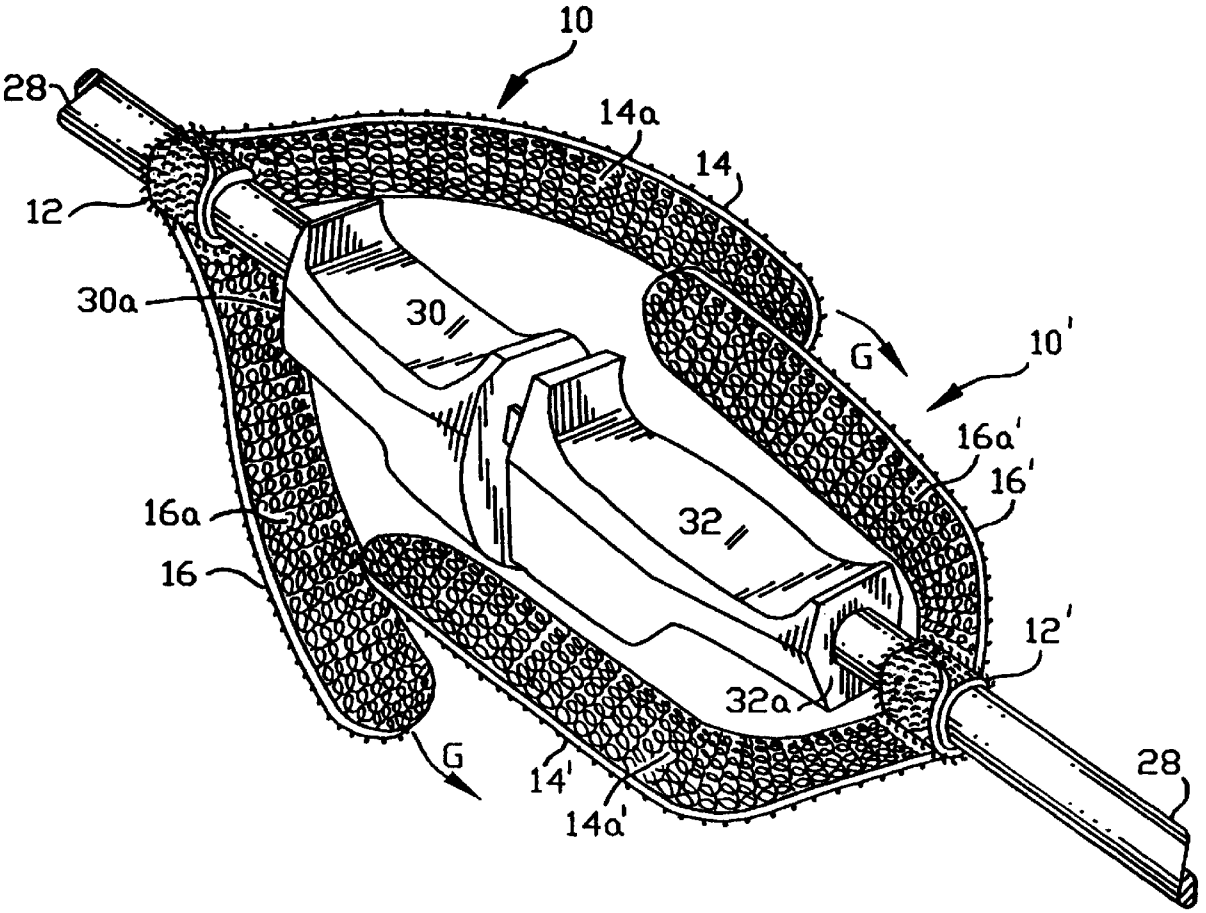
FIG. 3 is, in partially exploded perspective view, the opposed facing couplers of FIG. 2 being mated one onto the other.

As seen in FIG. 2, first portion 12 may be rotated in direction D so as to form the collar seen in FIG. 3 formed around electrical cord 28 by wrapping one end of first portion 12 over the opposite end. In the preferred embodiment, second and third portions 14 and 16 respectively, are formed side by side so that by wrapping the elongate free end 12*a* of first portion 12 over the end 12*b* adjacent goosenecks 18 and 20, second portion 14 and third portion 16 are rotated about the longitudinal axis E at the ends of the electrical cord adjacent mate plug 30 and female plug 32. The end result may be thought of as resembling "rabbit cars" in shape.

Axis E is the coupling axis parallel to which the prongs on male plug 30 are inserted into the corresponding female receptacles in female plug 32 as male plug 30 and female plug 32 are mated by translation in direction F to end up in a coupled position as seen in FIG. 3. With the collar formed by wrapping first portion 12, second portion 14 and third portion 16 are rotated about axis E so as to be radially spaced from each other about axis E, and, depending on the diameter of electrical cord 28, advantageously end up in generally opposed relation splayed on either side of the corresponding plug, whether it be male plug 30 or female plug 32.

With one coupler 10 so mounted to electrical cord 28 adjacent male plug 30, and another coupler 10 mounted on electrical cord 28 adjacent female plug 32, so that the pair of couplers 10 are in opposed facing relation, mating translation in direction F of male plug 30 relative to female plug 32 positions the second and third portions of both couplers so that they may be overlapped, a second portion on a first coupler overlapping a third portion on the second coupler and the third portion on the first coupler overlapping the second portion on the second coupler, or vice versa. In this way, the hooked surface on one of the couplers will overlap the looped surface on the other coupler. When pressed together, the respective second portion on the first coupler and the third portion on the second coupler, and third portion on the first coupler and second portion on the second coupler are releasably mated. This then utilizes the significant shear resisting strength of a hook and loop fastener along the length of the second and third portions to thereby resist tensile pulling apart of the male and female plugs in a direction opposite to direction F.

The overlapping is best understood by the illustration of FIG. 3 where second portion 14 is shown, by way of example, as having a looped surface 14a and where third portion 16 is shown as having a looped surface 16*a*. A first coupler 10 is ready for hook and loop releasable mating with a second coupler labelled 10'. Second coupler 10' has then its third portion 16' with its hooked surface, opposite to its looped surface 16*a*', outwardly facing so as to releasably mate with looped surface 14*a* on second portion 14 by overlapping second portion 14 in direction 0 onto third portion 16'. Similarly, third portion 16 is overlapped onto second portion 14' by overlapping in direction G so as to releasably mate looped surface 16*a* with the hooked surface of second portion 14' opposite to looped surface 14*a*.

Once first coupler 10 is releasably mated with second coupler 10', pulling apart of male plug 30 from female plug 32 is resisted by the sheer strength of the hook and loop mating between second portion 14 and third portion 16' and between third portion 16 and second portion 14'. The tensile loads during such pulling are taken up by first portions 12 and 12' sliding along electrical cord 28 so as to snug against the base ends 30*a* and 32*a* respectively of male plug 30 and female plug 32. The load is then transferred through goosenecks 18 and 20 so as to be born in the aforesaid mating between the first and second portions 14 and 16 on coupler 10 and the corresponding second portion 14' and third portion l6' on second coupler 10'.

In the embodiment where goosenecks are formed by cut-outs 22, 24 and 26, advantageously the cut-outs are smoothly contoured so as to avoid stress concentration points such as would be formed by slits or other crack-like apertures cut into the sides of the second and third portions. Thus during heavy industrial usage over extended periods of time, the hook and loop sheet fabric of which coupler 10 and coupler 10' is formed is much less likely to tear.

Figure 4:
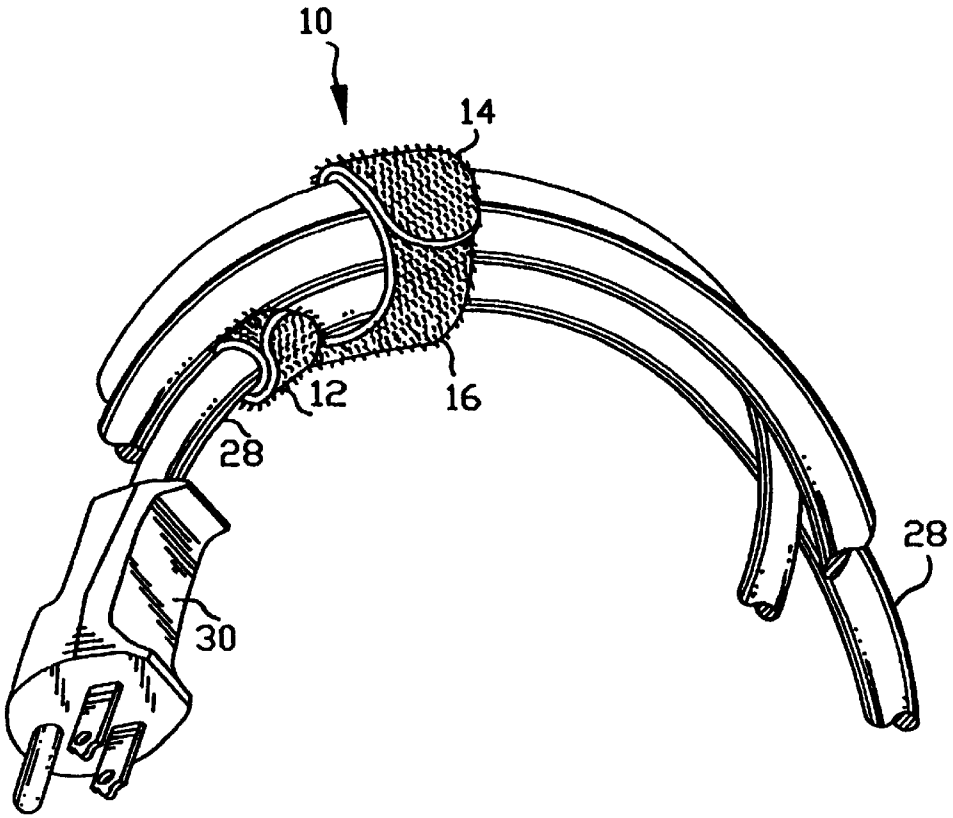
FIG. 4 is, in perspective view, the coupler of the present invention being used in its alternative application to store a coiled electrical cord.

For the coupling usage of coupler 10 seen in FIGS. 2 and 3, it being understood that coupler 10' is identical to coupler 10, it is not necessary that in fact the second and third portions be formed with goosenecks. However, goosenecks 18 and 20 are advantageous in the application illustrated in FIG. 4. As seen in FIG. 4, coupler 10 may be used to assist in bundling of electrical cord 28 when electrical cord is coiled ready to be stored after usage. Goosenecks 18 and 20 allow the second portion 14 and the third portion 16 to be more easily rotated about their corresponding longitudinal axes B and C by 90 degrees so that they may be wrapped one over the other to encircle a coiled electrical cord 28. Once so wrapped in releasable fastening thereover, when it is once again desired to use electrical cord 28, second portion 14 is merely pealed back from its overlapped position mated onto third portion 16. Coupler 10 is maintained in proximity to the plug, seen in FIG. 4 to be male plug 30 although not necessarily so, by leaving first portion 12 formed as a collar wrapped around the end of electrical cord 28 adjacent the plug.

Figure 5:
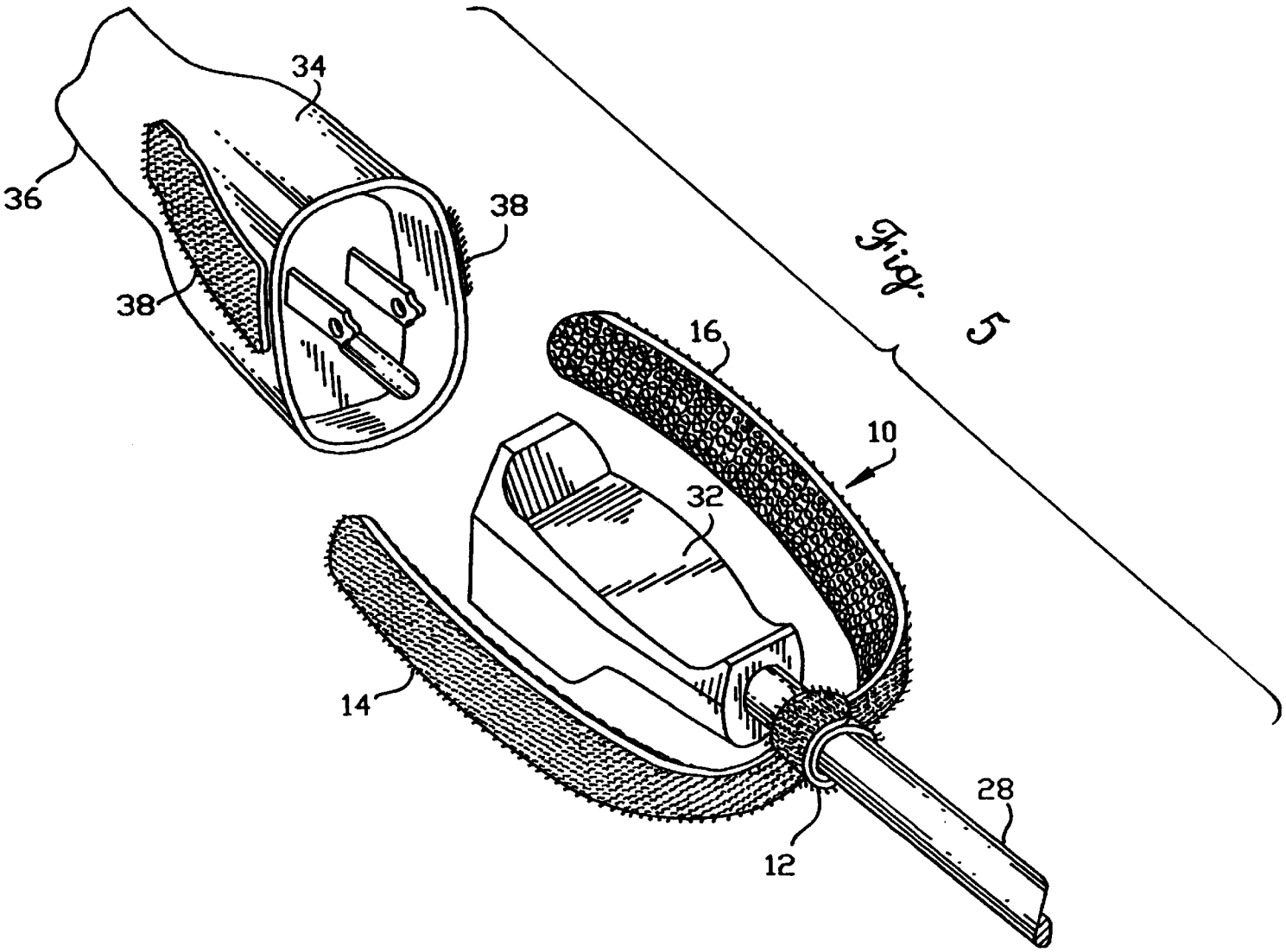
FIG. 5 is, in partially exploded perspective view, a coupler of the present invention being mounted to a rigid appliance.

As seen in FIG. 5, a single coupler 10 may be employed for releasable mating of female plug 32 on extension cord 28 with a rigid male electrical receptacle 34 such as are found rigidly mounted to appliances such as gardening tools including electric lawnmowers, hedge trimmers and the like, or other power tools. By way of example, in the embodiment of FIG. 5, male electrical receptacle 34 is formed in one end of the handle 36 of an electric hedge trimmer. Maintaining female plug 32 on the prongs of male receptacle 34 can be problematic. Thus, strips of Velcro™ 38 are fastened by adhesive to the exterior side walls of male receptacle 34, and the second and third portions 14 and 16 of coupler 10 then mounted to the Velcro™ strips to hold plug 34 in mated engagement with the prongs of male receptacle 34. It is understood that coupling according to this embodiment applies to all rigid appliances having rigid male receptacles, and also to electrical outlet boxes where strips of Velcro™ may be adhered or otherwise fastened to the box.

In preferred embodiments not intended to be limiting, first portion 12 may be 4 inches long and ½ inch wide, second and third portions 14 and 16 may be either 4 inches or 4 ½ inches long and either ⅞ inches or 1 inch wide, gooseneck cut-outs 22 and 24 may have a radius of either 3⁄16 of an inch or ¼ of an inch, and, correspondingly, cut-out 26 may have a diameter of either ⅜ of an inch or ½ of an inch. An extra tab end 12*c* may extend from the end of first portion 12 adjacent cut-out 22.

Figure 1A:
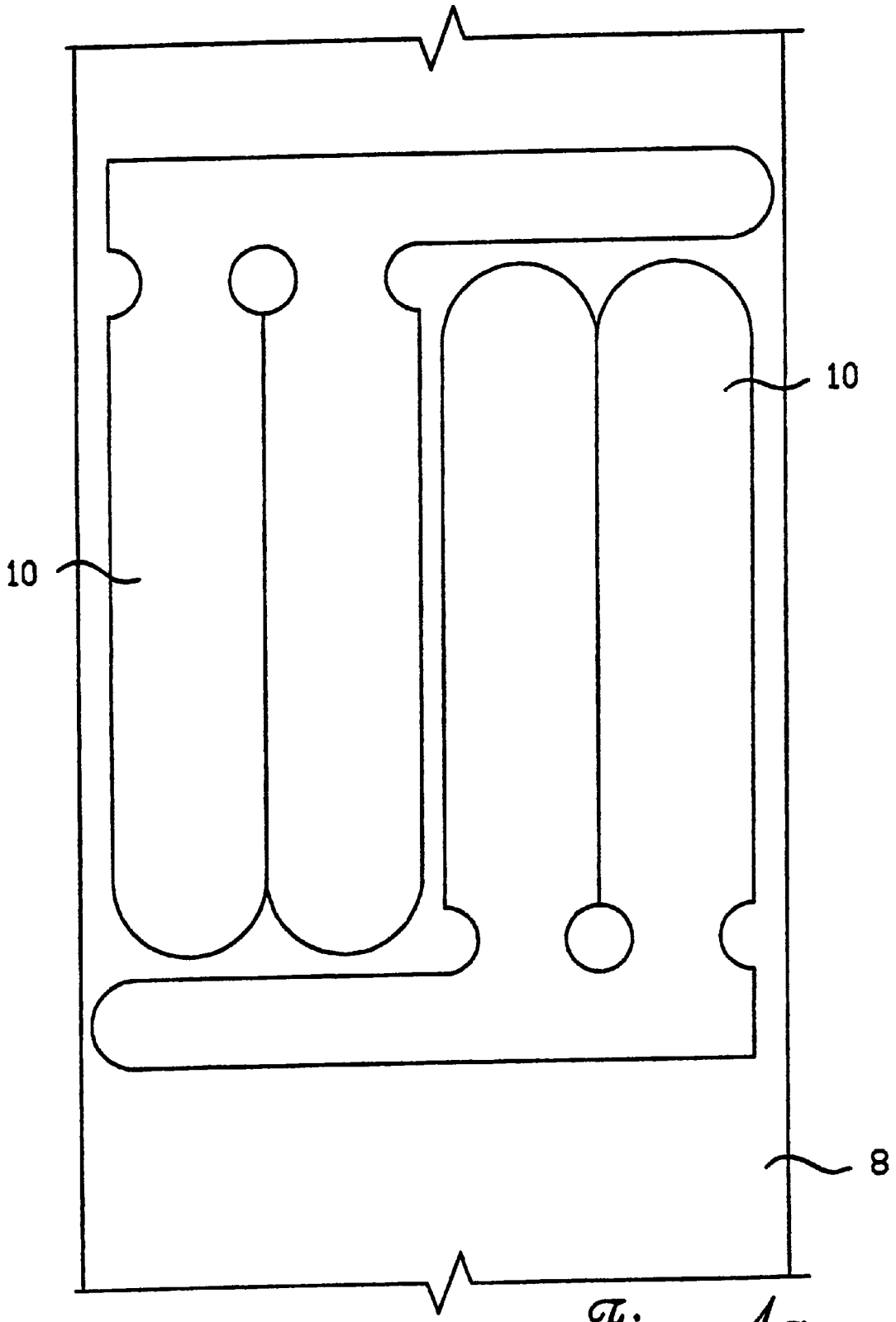
FIG. 1*a* is a pair of the couplers of FIG. 1, in a slightly different embodiment, being formed from a single sheet of material.

As seen in FIG. 1*a*, the shape of coupler 10 lends itself to efficient cutting of multiple couplings 10 from a single sheet 8 of double-sided hook and loop material by a "cookie-cutter" manufacturing process.

As will be apparent to those skilled in the art in the light of the foregoing disclosure, many alterations and modifications are possible in the practice of this invention without departing from the spirit or scope thereof Accordingly, the scope of the invention is to be construed in accordance with tie substance defined by the following claims.

What is claimed is:

1. A cord coupler comprising:

a flexible planar first sheet of hook and loop fastener material wherein a first side of said first sheet includes hook material of said hook and loop fastener material, and wherein an opposite second side of said first sheet includes loop material of said hook and loop fastener material, said first sheet formed into at least three portions, a first portion of said at least three portions elongate in a first direction from a first end of said first portion to an opposite second end of said first portion, a second portion of at least three portions elongate in a second direction from a first end of said second portion to an opposite second end of said second portion, a third portion of said at least three portions elongate in a third direction from a first end of said third portion to an opposite second end of said third portion, said first direction perpendicular to said second and third directions, said second and third directions parallel and said second portion adjacent said third portion, said first ends of said second and third portions formed integrally with said first end of said first portion, wherein a first plug on one end of a first electrical cord may be laid between said second and third portions so as to dispose a coupling end of said first plug away from said first portion and so as to lay said first electrical cord perpendicularly across said first portion, and wherein said first portion may be wrapped around said first electrical cord so as to releasably fasten said first end of said first portion to said second end of said first portion thereby forming a collar secured on said first electrical cord behind said first plug, and wherein said wrapping of said first portion around said first electrical cord oppositely rotates said second and third portions relative to each other into generally opposed facing relation on opposite sides of said first plug, and wherein said first ends of said second and third portions are formed as goosenecks, said goosenecks smoothly contoured cut-outs substantially devoid of stress concentration points along side edges of said first ends of said second and third portions, whereby said second and third portions are positioned and adapted for releasable fastening to corresponding releasable fasteners on a second plug when mated to said first plug, and whereby said second and third portions are also positioned for securing said first electrical cord, when coiled, to said first plug by wrapping and releasably securing said second and third portions around coils of said first electrical cord when coiled.

2. The cord coupler of claim 1 wherein said corresponding releasable fasteners on said second plug are second and third portions of a second sheet substantially identical to said first sheet, and wherein said second plug is mounted on an end of a second electrical cord, and wherein said second sheet is mounted to said end of said second electrical cord behind said second plug by wrapping a first portion of said second sheet around said second electrical cord behind said second plug, and wherein said second portions and said third portions of said first and second sheets may be overlapped into releasably fastened engagement so as to releasably secure said first plug coupled to said second plug.

3. The cord coupler of claim 1 wherein said corresponding releasable fasteners on said second plug are strips of releasable fastener material mounted directly onto opposite sides of said second plug.

4. The cord coupler of claim 3 wherein said second plug is an electrical plug rigidly mounted to an appliance.

5. The cord coupler of claim 4 wherein said appliance is a hand tool.

6. The cord coupler of claim 1 wherein said first sheet is double-sided hook and loop material having solely hook pile on said first side of said first sheet, and having solely loop pile on said second side of said first sheet.

7. The cord coupler of claim 6 wherein said first sheet is cut to shape by a cookie-cutter method from a bulk supply of said double-sided hook and loop material.

8. The cord coupler of claim 2 wherein said first and second sheets are double-sided hook and loop material each having solely hook pile on said first sides of said first and second sheets, and having solely loop pile on said second sides of said first and second sheets.

9. The cord coupler of claim 8 wherein said first and second sheets are cut to shape by a cookie-cutter method from a bulk supply of said double-sided hook and loop material.

10. The cord coupler of claim 1 wherein said cut-outs arc formed in said first sheet between said first ends of said first, second and third portions.

11. The cord coupler of claim 10 wherein said cut-outs include a first stress reduction aperture between said first ends of said second and third portions so as to form one end of an elongate split running along the length of, and between, said second and third portions.

12. The cord coupler of claim 11 wherein said second and third portions are immediately adjacent each other.

13. The cord coupler of claim 12 wherein said cut-outs further include oppositely disposed, substantially semi-circular notches formed in opposite sides of said first ends of said second and third portions immediately adjacent said first end of said first portion, and wherein said first stress reduction aperture is substantially circular.

14. The cord coupler of claim 1 wherein said first, second and third portions have corresponding first, second and third lengths, and wherein said first length is generally equal to said second and third lengths.

15. The cord coupler of claim 14 wherein said first, second and third portions have corresponding first, second and third widths measured lying in a plane of said first sheet, and wherein said first width is less than said second and third widths and said second and third widths are substantially equal.

* * * * *